United States Patent [19]

Zeller

[11] 4,000,845

[45] Jan. 4, 1977

[54] PARTITION ASSEMBLY AND PARTITION STRIPS THEREFOR

[75] Inventor: Allen D. Zeller, Merced, Calif.

[73] Assignee: Clevepak Corporation, New York, N.Y.

[22] Filed: Oct. 20, 1975

[21] Appl. No.: 623,746

[52] U.S. Cl. ..... 229/15; 217/32

[51] Int. Cl.[2] ..... B65D 85/00

[58] Field of Search ..... 229/15, 42; 217/30, 217/31, 32, 33

[56] References Cited

UNITED STATES PATENTS

| | | | |
|---|---|---|---|
| 213,848 | 4/1879 | Stevens | 217/32 |
| 436,538 | 9/1890 | Mitchell | 217/31 |
| 654,508 | 7/1900 | Bohn | 217/32 |
| 1,313,948 | 8/1919 | Maegly | 217/32 UX |
| 1,805,870 | 5/1931 | Inman | 217/32 X |
| 1,919,458 | 7/1933 | Benoit | 217/32 |
| 2,920,782 | 1/1960 | Butters | 229/15 X |
| 3,203,612 | 8/1965 | Schaeffer | 229/15 |

*Primary Examiner*—Davis T. Moorhead
*Attorney, Agent, or Firm*—Rogers, Eilers & Howell

[57] ABSTRACT

A partition assembly having interlocking longitudinal and transverse partition strips to form compartments or cells for the reception of bottles, cans or other containers. The strips have sections that form the walls of the cells and are defined by spaced slots in each strip extending from one edge and a substantial depth into the strip and relatively shallow notches in the opposite edge of the strip in alignment with said slots. A set of sections, including the section at one end of each strip, has tabular projections near one edge extending into the slots in one direction, and a section at the opposite end of the strip has a tabular projection extending into a slot but in the opposite direction, the slots of the longitudinal strips interfitting with the slots of the transverse strips with the tabs of one interlocking in notches of the other forming a partition assembly.

5 Claims, 8 Drawing Figures

PARTITION ASSEMBLY AND PARTITION STRIPS THEREFOR

BACKGROUND AND SUMMARY OF THE INVENTION

Partition assemblies are commonly used to divide boxes, crates and the like into a plurality of cells for containing and protecting goods such as bottles, cans or other containers. These assemblies are commonly inserted in the boxes and filled by automatic machinery. The present invention relates to the art of such partitions and more particularly to a novel structure and arrangement of partition strips, slots and tabular projections which provide improved stability to the partition assembly in both the open and collapsed conditions.

The art of providing protective partition assemblies for glass containers and the like is illustrated by U.S. Pat. No. 3,203,612 to Schaefer. In prior art partition assemblies, longitudinal and transverse partition strips are interlocked to provide cells for enclosing the containers; however, such assemblies lack the degree of stability desired in the outer cell walls, the cells most prone to distortion, because the design of the partition strips leaves much of these outer cell walls unsupported. Without support at the ends of the strips, the outer cell walls are easily bent, deflected or distorted from the proper position in the assembly which can cause interference with the loading of the containers as the containers strike the edges of the distorted walls.

In some prior art assemblies, tabs located at the edges of the longitudinal partition strips interlock with notches of transverse strips, and tabs of transverse strips similarly interlock in notches of longitudinal strips. The tabs on each strip all face in one direction so that, consequently, the cell walls formed at one end of the longitudinal strips have no tabs which interlock in notches of the transverse strip. Likewise, the cell walls formed at one end of the transverse strips have no tabs which interlock in notches of the longitudinal strip. Thus, about half of the outer cell walls are left relatively weak and flimsy often resulting in expensive down time on the automatic loading equipment, due to jamming and the like.

The partition assembly of the present invention overcomes these problems and provides significant advantages in providing an assembly wherein all the outer cell walls, the outer sections of each of the strips, are supported with interlocking tabs and notches to greatly increase stability and reduce distortion and down time during insertion and packaging. This is accomplished by reversing the tab at one end of each strip so that each strip has tabs at opposite ends that face each other. Thus, each longitudinal strip has a set of sections or walls, including one end section, which have tabs facing in the same direction and in alignment with each other, adapted to interlock in notches of similarly sectionalized transverse partition strips. It also has a section at the opposite end which has a tab also aligned with the others in the strip, but facing in the opposite direction. This tab interlocks with a notch in a transverse or cross strip so that the sections at both ends of the strip are locked and cannot be displaced to distort the cells which they form. Stabilization is provided at the edge of the longitudinal strip opposite the tabs by wide band area which connects each section to its adjacent section, relatively shallow notches being formed in alignment with and in the edge opposite the tabs.

Transverse strips are inverted relative to the longitudinal strips, but are otherwise similarly formed with tabs at opposite ends facing each other. The longitudinal and transverse strips interfit with the tabs of one interlocked in the notches of the other to provide stability for all the outer cell walls.

In one embodiment of the invention, only one set of strips, either transverse or longitudinal, has oppositely facing tabs on the end sections. This set of strips is arranged so as to have its tabs on the top side of the partition assembly to provide support against distortion at the tops of the outer cells where the containers enter during loading.

The present invention provides additional advantages. In the collapsed or flat condition of the assembly, the oppositely facing tabs help prevent the strips from coming apart during shipping, handling, and loading operations, thus increasing reliability and reducing the possibility of damage to the assembly. Also, the stacking strength of the loaded assemblies is increased because the walls of the cells are maintained relatively straight and thus support more weight than an assembly with distorted cell walls.

These and other advantages will become apparent from the detailed description to follow.

DESCRIPTION OF A PREFERRED EMBODIMENT

Figure 1:
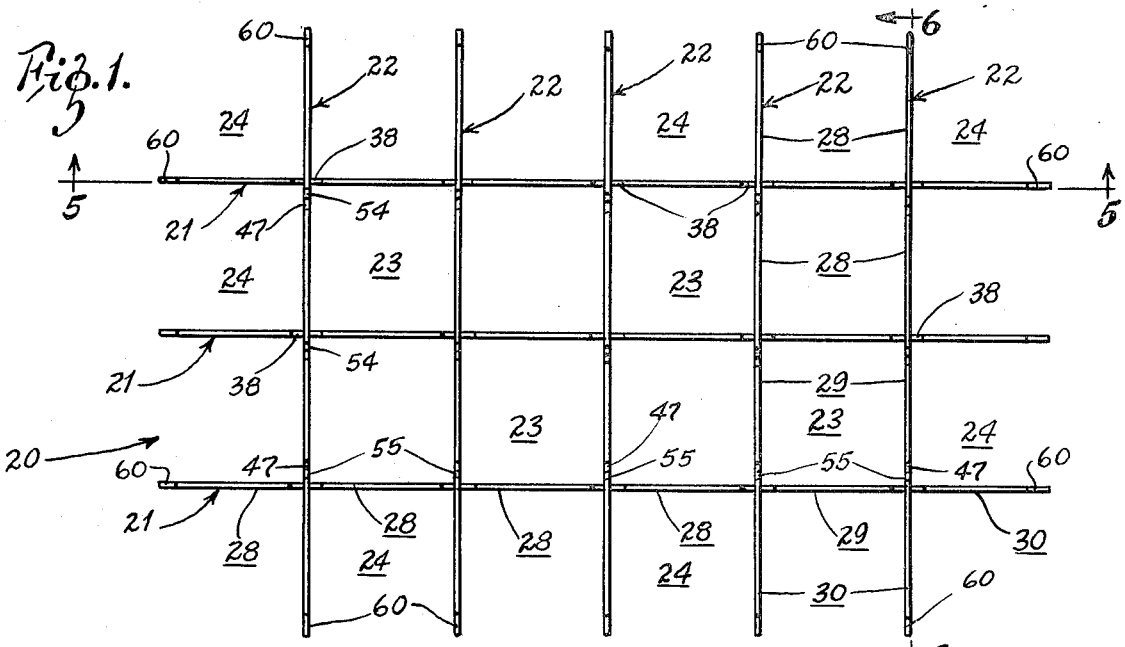
FIG. 1 is a plan view of the partition arrangement showing the longitudinal and transverse partition strips.
Figure 2:
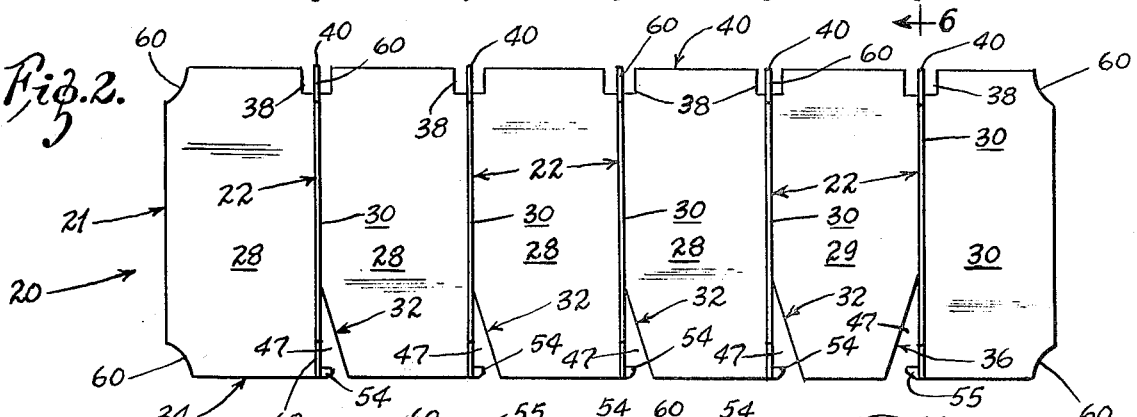
FIG. 2 is a front end view of FIG. 1.
Figure 3:
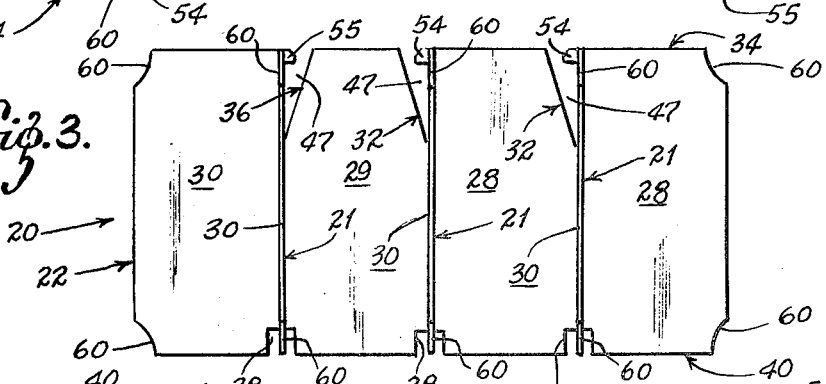
FIG. 3 is a right end view of the partition arrangement of FIG. 1.
Figure 5:
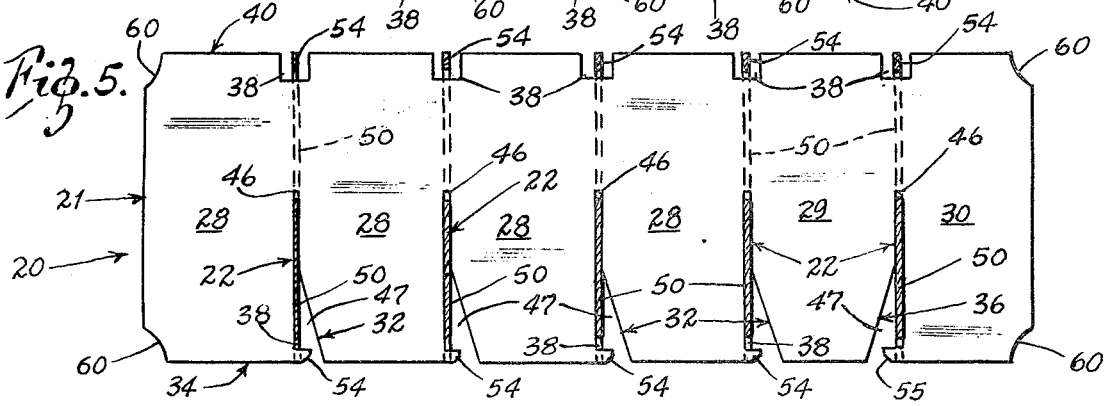
FIG. 5 is a sectional view taken on the line 5—5 of FIG. 1.
Figure 4:
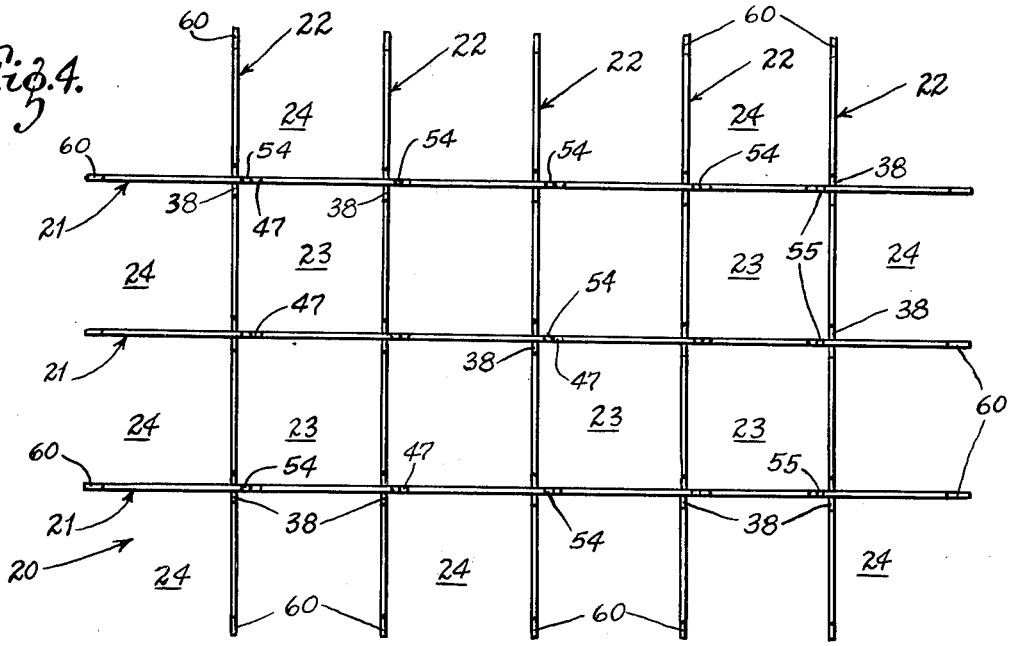
FIG. 4 is a bottom view of the partition arrangement.
Figure 6:
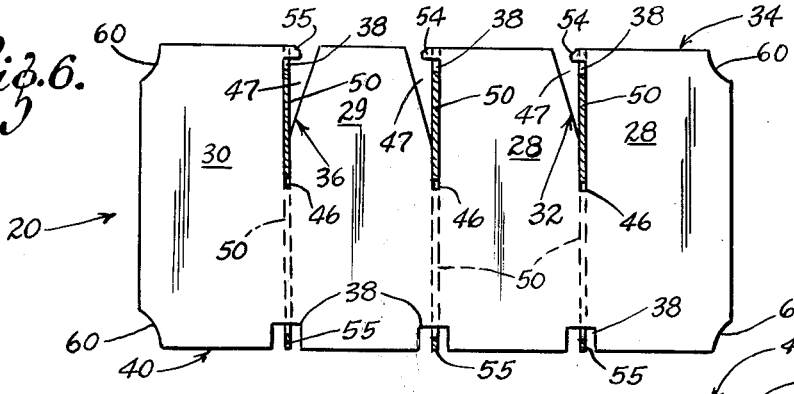
FIG. 6 is a sectional view taken on the line 6—6 of FIG. 1.

Referring to the drawing, there is shown a partition assembly 20 of this invention having a set of longitudinal strips 21 and transverse or cross strips 22 interlocked in a lattice arrangement defining inner cells 23 and outer cells 24 for the reception of bottles, cans, or other containers. The strips 21 and 22 can be made of a flexible, inexpensive material such as paperboard, and the like, and can be formed by cutting and scoring paperboard stock on conventional die cutting machines. The number and sizes of the strips can vary according to the size of the partition assembly desired.

Figure 7:
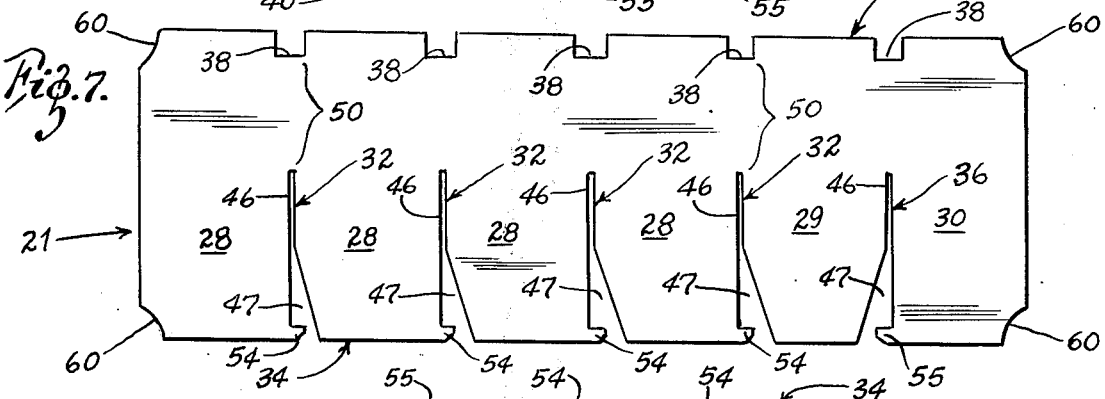
FIG. 7 is a side view of a longitudinal partition strip.
Figure 8:
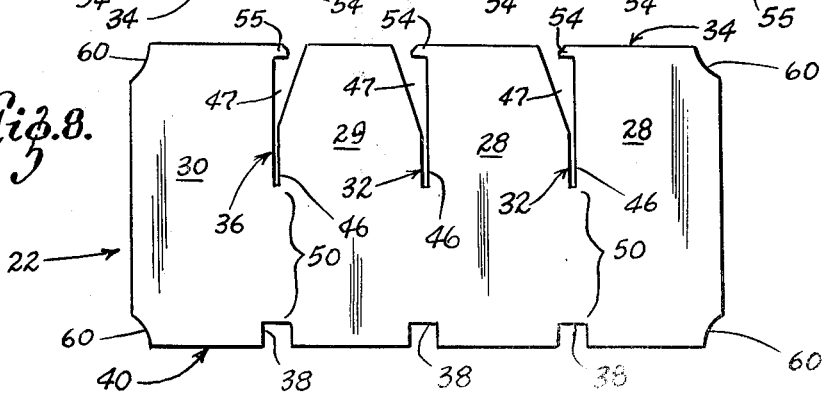
FIG. 8 is a side view of a transverse partition strip.

As noted particularly by FIGS. 7 and 8, the strips 21 and 22 are essentially identical, and in assembly one is inverted relative to the other, and positions transversely with respect to the other, so as to be interlocked. Thus, each of the strips 21 and 22 has sections 28, a section 29 and a section 30, the sections 28 and 29 being separated from one another by slots 32 extending from one edge 34 of the strip about half-way in depth, into the strip, and the sections 29 and 30 being separated by a slot 36 also extending from the edge 34 about half-way in depth. It will be noted that the section 30 is an end section of the strip and that slot 36 is adjacent that end section and is generally the mirror image of the slots 32. Opposite each of the slots 32 and 36 are shallow notches 38 formed in the opposite edge 40 of the strip and in alignment with the slots. The sections 28, 29 and 30 define the walls of the cells 23 and 24 of the partition assembly.

The slots 32 and 36 each have a narrow bottom portion 46 which extend into a top flared portion 47, with the top flared portion 47 of the slot 36 being flared in the opposite direction to the flared portions of the slots 32 in the manner shown. The sections 28, 29 and 30 of each o the strips are held together by a 28, 29 and 30 of each of the strips are held together by a band portion 50 extending between the slots and notches.

Associated with each of the sections 28 and located at the edge 34, are tabs 54 which are in alignment and which extend in the same direction into the flared portions of the slots 32. It is a primary feature of this invention that the section 30, constituting an end section of each strip, has a tab 55 in alignment with the tabs 54 and extending into the flared portion of the slot 36 in a direction opposite to, and so as to face, the tabs 54. As will be seen, the reversal of the tabs 55 relative to the tabs 54 provides a means by which all of the outer cell walls are supported. The section 29, constituting a wall of one of the inner cells, has no tabular projection. The corners 60 of the partition strips 21 and 22 are formed with concave arcuate edges which allow ease in installing the partition assembly into a box or crate.

The number of partition sections 28 having tabs 54 can vary according to the desired size of the partition arrangement and as few as one of such sections can be provided for each strip. However, in each partition strip in the assembly, there will normally be only one section 29 which has no tabs. There will also be in each strip at least one section 30 that has a tab 55 facing in the opposite direction to the tabs 54. If there is only one section 30, it should be at the end of the strip to provide support for the outer cell walls where such support is most critical.

OPERATION OF THE INVENTION

The partition strips 21 and 22 are assembled in the manner shown in FIGS. 1 through 6 of the drawing with the slots 32 and 36 of the strips 21 interfitting in corresponding slots 32 and 36 of the strips 22, such that the tabs 54 and 55 of the strips 21 engage in the notches 38 of the strips 22 and the tabs 54 and 55 of the strips 22 engage in the notches 38 of the strips 21. In this condition it will be seen that the bottoms of the slots 46 in the strips 21 and 22 make contact, or very nearly make contact, and the slots 32 and 36 of one set of strips receive the band portions 50 of the other set. With the strips interfitted in this manner, one side of the sections 28, 29 and 30 of each of the strips is substantially supported by the wide band areas 50, so that there is very little flexing that can occur at those ends of the sections. The opposite ends of the sections 28 and 30 are supported against flexing by the engagement of the tabs 54 and 55 of one strip in the associated notches 38 of the cross strips so that the outer cell walls and most of the inner cell walls are fully supported. Only the section 29 is left comparatively unsupported at one end, but with this section forming an interior wall of the assembly, it is of little consequence since it is much less prone to distortion than outer cell walls.

In the assembly shown in the drawing, both strips 21 and 22 have tabs 55 facing in the opposite direction to the tabs 54. In an alternate embodiment of the invention, only one such set of strips, either the longitudinal strips 21 or the transverse strips 22, have the oppositely facing tabs. In such an alternate construction, it is preferable that the tabs 54 and 55 on the one set of strips be located at the top of the assembly, with the tabs 54 of the other set of strips being located at the bottom. This insures that the tops of the cell walls are supported, which is critical for proper entry of the containers into the assembly during loading.

The partition assembly 20 can be placed in the collapsed position when outside of its box or crate by pushing against opposite corners of the assembly. The longitudinal strips 21 and transverse strips 22 will then close toward each other until they are in a position in which they overlie one another. The oppositely facing tabs 54 and 55 provide increased stability in the collapsed position so that the strips 21 and 22 are less likely to come apart during handling, shipping, assembly and the like.

Thus there has been described an improved partition assembly and partition strips therefor wherein the strips have oppositely facing tabs providing the advantages heretofore described.

Various changes and modifications may be made in this invention, as will be readily apparent to those skilled in the art. Such changes and modifications are within the scope and teaching of this invention as defined by the claims appended hereto.

What is claimed is:

1. A partition strip for use in a partition assembly comprising means to interlock with cooperating cross partition strips, the interlocking means including a plurality of generally parallel slots in the partition strip, the slots dividing the partition strip into a plurality of sections, including a first section having a projection extending at an edge of said strip into a slot, a second section having a projection extending at said edge into another slot and facing opposite to said projection of the first section, the first and second sections being at opposite ends of the strip and said projections of said first and second sections facing each other, intermediate sections between said first and second sections, all but one of said intermediate sections having projections extending at said edge into other of said slots, the strip further including notches in the edge of the strip opposite said projections and in alignment with said slots for reception of projections of cross strips, whereby all of the sections of the partition strip except one intermediate section have projections, the projections of the outer end sections facing each other, for supporting engagement with notches of cross strips.

2. The partition strip of claim 1 wherein the notches are relatively shallow compared to said slots, and the slots extend in depth about halfway into the strip.

3. A partition assembly comprising first and second sets of partition strips, the strips in each set being parallel and the strips in one set being oriented transversely relative to the strips in the other set with the assembly in the open configuration, each strip in each set comprising means to interlock with strips in the other set, the interlocking means including a plurality of generally parallel slots in each partition strip, the slots dividing the partition strip into a plurality of sections, the sections of the strips in each set including a first section having a projection extending at an edge of said strip into a slot, a second section having a projection extending at said edge into a slot and facing opposite said projection of the first section, said first and second sections being at opposite ends of the strip and said projections of said first and second sections facing each other, and intermediate sections between said first and second sections, all but one of said intermediate sections having projections extending at said edge into other of said slots, each strip in each set of strips including notches in the edge of the strip opposite said slots, the notches of one set of strips receiving the projections of the other set, whereby all of the sections, except one of the intermediate sections of each partition strip in each set of strips of the assembly are supported by the engagement of projections extending therefrom and into notches of the other set of strips.

4. The partition assembly of claim 3 wherein the dimensions of the sections in each set of strips are substantially the same, the notches in each strip being relatively shallow and the slots in each strip extending in depth approximately halfway through the strip such that the tabular projections of one set of strips engage in the notches of the other set.

5. The partition strip of claim 1 wherein the dimensions of the sections are substantially the same.

* * * * *